United States Patent [19]

Rymas

[11] Patent Number: 4,650,353

[45] Date of Patent: Mar. 17, 1987

[54] PRINTER WIRE

[75] Inventor: Frank Rymas, Sterling Hts., Mich.

[73] Assignee: GTE Products Corporation, Stamford, Conn.

[21] Appl. No.: 381,492

[22] Filed: May 24, 1982

[51] Int. Cl.[4] ..... B41J 3/12

[52] U.S. Cl. ..... 400/124; 101/93.05; 75/236

[58] Field of Search ..... 400/124; 101/93.05; 75/236

[56] References Cited

U.S. PATENT DOCUMENTS 3,771,975 11/1973 Frehn ..... 75/236

3,828,908 8/1974 Schneider ..... 400/124

4,194,910 3/1980 Mal et al. ..... 75/236

4,256,948 3/1981 Wolf et al. ..... 400/124 X 4,307,966 12/1981 Spencer et al. ..... 400/124

FOREIGN PATENT DOCUMENTS 2816455 10/1978 Fed. Rep. of Germany ..... 400/124

*Primary Examiner*—Paul T. Sewell

*Attorney, Agent, or Firm*—Robert E. Walter

[57] ABSTRACT

A printer wire for a printer wire assembly consists essentially of a metal carbide dispersed throughout a metal matrix wherein said metal carbide comprises titanium carbide and the matrix comprises nickel.

7 Claims, No Drawings

PRINTER WIRE

BACKGROUND OF THE INVENTION

This invention relates to a printer wire for printer wire assemblies used in dot matrix printers.

Dot matrix printers have the capability of high speed printing and are useful, for example, in producing computer print-outs. Characters such as letters and numerals are formed by an array of dots printed on the print-out sheet by selective electronic activation of an array of printer wires.

The printer wires are fabricated from a material such as tungsten, tungsten-rhenium alloy or tungsten carbide and each is supported by a steel pin or armature. The armature has a socket for receiving the base portion of the wire.

Printer wires made from various steel alloys are used in some low speed printing applications. Since steel wires have low wear resistance they have not been used for the higher speed printing applications. Tungsten and its alloys have better wear resistance than steel but are not sufficiently wear resistant for high speed, long life printing applications. Printer wires made from cemented tungsten carbide have high abrasion resistance and sufficient strength for long life at high printing speeds. As printers are developed which operate at increased speeds, it is desirable to develop printer wires which aid in the performance of printers.

SUMMARY OF THE INVENTION

Manufacturers of high speed impact printers are continually striving to increase the speed at which the printers operate. One limitation to increased speed is the weight of the printer wire. High weight corresponds to high inertia which results in high resistance to accelleration and de-accelleration of the printer wire. Since strength and design consierations place limits upon mimimum wire diameter and length, my invention results in a printer wire material having high strength, high wear resistance but with a low density.

In accordance with the present invention, a printer wire for a printer wire assembly consists essentially of a metal carbide dispersed throughout the metal matrix wherein said metal carbide comprises titanium carbide present in an amount from about 40 to about 75 percent of a total weight and said metal matrix comprises nickel present in an amount from about 25 to about 60 percent by weight of the total weight of said wire.

The printer wire has the desirable properties of high abrasion resistance, sufficient strength for long life at high printing speeds together with low density. The density of the wire of the present invention is about 6.5 grams per cubic centimeter as compared with tungsten which has a density of about 19.3 grams per cubic centimeter and cemented tungsten carbide which has a density of about 13.4 grams per cubic centimeter.

DETAILED DESCRIPTION

Titanium carbide is used in the printer wire of the present invention in an amount ranging from about 40 to about 75 percent by weight. At least about 45 percent by weight titanium carbide is preferred to give good weight reduction which permits higher printer speed.

Titanium carbide can be obtained commercially or be synthesized by methods well known to the art. The titanium carbide should be finely divided, having a particle size of less than about 5 microns and preferably less than about 2 microns.

Nickel is used in the composition in the present invention as a matrix and is present in an amount from about 25 to about 60 weight percent. Preferably the amount of nickel is from about 35 to about 50 weight percent.

Molybdenum or molybdenum carbide may be used together with nickel to give improved wetting of the carbide phase to enable a strong cemented composition to be made. When molybdenum is used in this manner, it is contemplated that molybdenum is present in an amount from about 5 to about 40 percent by weight and more preferably from about 10 to about 30 percent by weight.

The starting materials used in the compositions of the present invention should be in pure powder form. It is desirable to exclude impurities such as oxygen which tend to have deleterious effects on the dense composition. On the other hand, minor amounts of many impurities can be tolerated with no appreciable loss of properties. Thus the metal can contain small amounts of other metals such as titanium, zirconium, tantalum, or niobium as minor impurities. Small amounts of carbides other than titanium carbide, such as several percent of tungsten carbide, which is sometimes picked up in grinding can be present. It is also contemplated that the metal binder phase may include ingredients other than nickel or even exclude molybdenum as described above.

In preparing the compositions of the present invention, fine-grained starting materials are thoroughly milled to give a uniform mixture of starting materials. The starting powder is thoroughly mixed with an organic binder which permits subsequent extrusion of the milled mixture to a rod or wire form. The extruded rod or wire is sintered to a dense-pore-free body by sintering. The sintering is typically performed in a vacuum at temperatures of from about 1350° to about 1475° C. for a period of time of from about one to about two hours. The resulting densified bodies of the present invention have a fine average grain size of less than about two microns which is substantially uniform throughout the composition. The distribution of the titanium carbide in the metal matrix is substantially uniform and homogeneous resulting in a wire having high strength.

The printer wires of the present invention typically have a diameter of from about 10 to about 20 thousandths of an inch and a length of from about 2.5 inches to about 4 inches. Rockwell hardness is from about 85 $R_a$ to about 91 $R_a$. The density is preferably from about 5.5 to about 7.0 grams per cubic centimeter. The strength of the wires produced are preferably from about 300,000 to about 600,000 pounds per square inch.

EXAMPLE

A fine powder titanium carbide, nickel powder, and molybdenum powder are milled in a ball mill for 150 hours period of time. About three parts of titanium carbide and 1.5 parts of nickel are used per one part of molybdenum. After milling the powder is thoroughly and uniformly mixed with about 0.2 parts by weight of a binder per part of powder. The organic wax binder and powder mixture is then extruded through an extruder to produce a green wire shape having a length of about 33 inches and a diameter of about 0.027 inches. The extruded wire is then sintered in a vacuum at about 1375° for about 1.5 hours to give a printer wire having the following properties: grain size less than one micron, hardness Rockwell 89.5, density 6.49 grams per centimeter, porosity A-1, coercive force 0, strength 326 thousand pounds per square inch.

I claim:

1. A printer wire of a printer wire assembly consisting essentially of a metal carbide dispersed throughout a metal matrix wherein said metal carbide comprises titanium carbide present in an amount from about 40 to about 75 percent of the total weight and said metal matrix comprises nickel present in an amount from about 25 to about 60 percent by weight of the total weight of said wire.

2. A printer wire according to claim 1 wherein said metal carbide consists essentially of titanium carbide.

3. A printer wire according to claim 2 wherein said matrix consists essentially of nickel and molybdenum, said molybdenum being present in an amount from about 5 to about 40 weight percent.

4. A printer wire according to claim 3 wherein said wire comprises less than about 2 percent by weight other ingredients.

5. A printer wire according to claim 4 having a diameter from about 0.010 inch to about 0.020 inch.

6. A printer wire according to claim 5 having a length of 2.5 inch to about 4.0 inch.

7. A printer wire according to claim 6 having a density of from about 5.5 to about 7.0 grams per cubic centimeter.

* * * * *